US010680379B2

(12) United States Patent
Wu et al.

(10) Patent No.: US 10,680,379 B2
(45) Date of Patent: Jun. 9, 2020

(54) ELECTRICAL CONNECTOR WITH METALLIC SHELL ENCLOSING AND SECURING MAGNET VIA WELDING

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Xiao-Xiang Wu, Kunshan (CN); Wei Zhong, Kunshan (CN); Jian-Kuang Zhu, Kunshan (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/387,472

(22) Filed: Apr. 17, 2019

(65) Prior Publication Data

US 2019/0319392 A1 Oct. 17, 2019

(30) Foreign Application Priority Data

Apr. 17, 2018 (CN) ..... 2018 2 0547763 U

(51) Int. Cl.
*H01R 13/504* (2006.01)
*H01R 13/6585* (2011.01)
*H01R 13/62* (2006.01)

(52) U.S. Cl.
CPC ..... *H01R 13/504* (2013.01); *H01R 13/6205* (2013.01); *H01R 13/6585* (2013.01)

(58) Field of Classification Search
CPC .. H01R 13/6205; H01R 11/30; H01R 13/504; H01R 13/6585
USPC ..... 439/39
See application file for complete search history.

(56) References Cited

U.S. PATENT DOCUMENTS

| | | | | |
|---|---|---|---|---|
| 8,894,420 | B2 * | 11/2014 | Schichl | H01R 13/5841 439/39 |
| 9,130,317 | B2 * | 9/2015 | Wang | H01R 13/6683 |
| 9,252,531 | B2 * | 2/2016 | Guo | H01R 13/506 |
| 2015/0104959 | A1 * | 4/2015 | Guo | H01R 13/506 439/39 |
| 2015/0244105 | A1 * | 8/2015 | Peng | H01R 13/6205 439/39 |

(Continued)

FOREIGN PATENT DOCUMENTS

CN 203589349 U 5/2014

*Primary Examiner* — Gary F Paumen
(74) *Attorney, Agent, or Firm* — Wei Te Chung; Ming Chieh Chang

(57) ABSTRACT

An electrical connector includes an insulative housing, a plurality of contacts retained in the housing, a metallic shell enclosing the housing, and the magnets retained by the shell. The housing includes a pair of longitudinal walls and a pair of end walls commonly forming a mating cavity. The contacts are disposed in the longitudinal walls with corresponding contacting sections exposed in the mating cavity. The shell forms receiving cavities to intimately receive the corresponding magnets, respectively. The magnets are secured to the shell by spot-welding so as to not only assure reliable securement therebetween but also keep the completeness of both the magnet and the shell for superior magnetic and shielding effect thereof.

20 Claims, 12 Drawing Sheets

(56) References Cited

U.S. PATENT DOCUMENTS

| | | | | |
|---|---|---|---|---|
| 2017/0352992 | A1* | 12/2017 | Lin | H01R 12/7005 |
| 2018/0054012 | A1* | 2/2018 | Zhu | H01R 4/027 |
| 2018/0166831 | A1* | 6/2018 | Zhu | H01R 13/6581 |

* cited by examiner

ELECTRICAL CONNECTOR WITH METALLIC SHELL ENCLOSING AND SECURING MAGNET VIA WELDING

BACKGROUND OF THE INVENTION

1. Field of the Invention

The present invention relates generally to an electrical connector, and more particularly to an electrical connector with the magnets enclosed in a metallic shell and secured thereto via welding for assuring intimate securement therebetween and maintaining completeness of the metallic shell.

2. Description of Related Arts

U.S. Pat. No. 9,252,531 discloses an electrical connector equipped, at two opposite ends, with a pair of magnets enclosed within and secured by a metallic shell wherein the magnet forms a recess and the shell forms a retaining arm split therefrom to be engaged within the recess for retention. Anyhow, such an engagement lacks fully intimate relation but with tiny gaps thereabouts, and the recessed structure in the surface of the magnet may damage the completeness of the magnet, thus jeopardizing the magnitude of the magnetic force thereof. In addition, the split type retaining arm may also damage the completeness of the exterior surface of the shell, thus jeopardizing the shielding and strength effect of the shell, disadvantageously.

An improved electrical connector is desired.

SUMMARY OF THE INVENTION

An object of the present invention is to provide an electrical connector with an insulative housing, a plurality of contacts retained in the housing, a metallic shell enclosing the housing, and the magnets retained by the shell. The housing includes a pair of longitudinal walls and a pair of end walls commonly forming a mating cavity. The contacts are disposed in the longitudinal walls with corresponding contacting sections exposed in the mating cavity. The shell forms receiving cavities to intimately receive the corresponding magnets, respectively. The magnets are secured to the shell by spot-welding so as to not only assure reliable securement therebetween but also keep the completeness of both the magnet and the shell for superior magnetic and shielding effect thereof.

DETAILED DESCRIPTION OF THE PREFERRED EMBODIMENT

Figure 1:
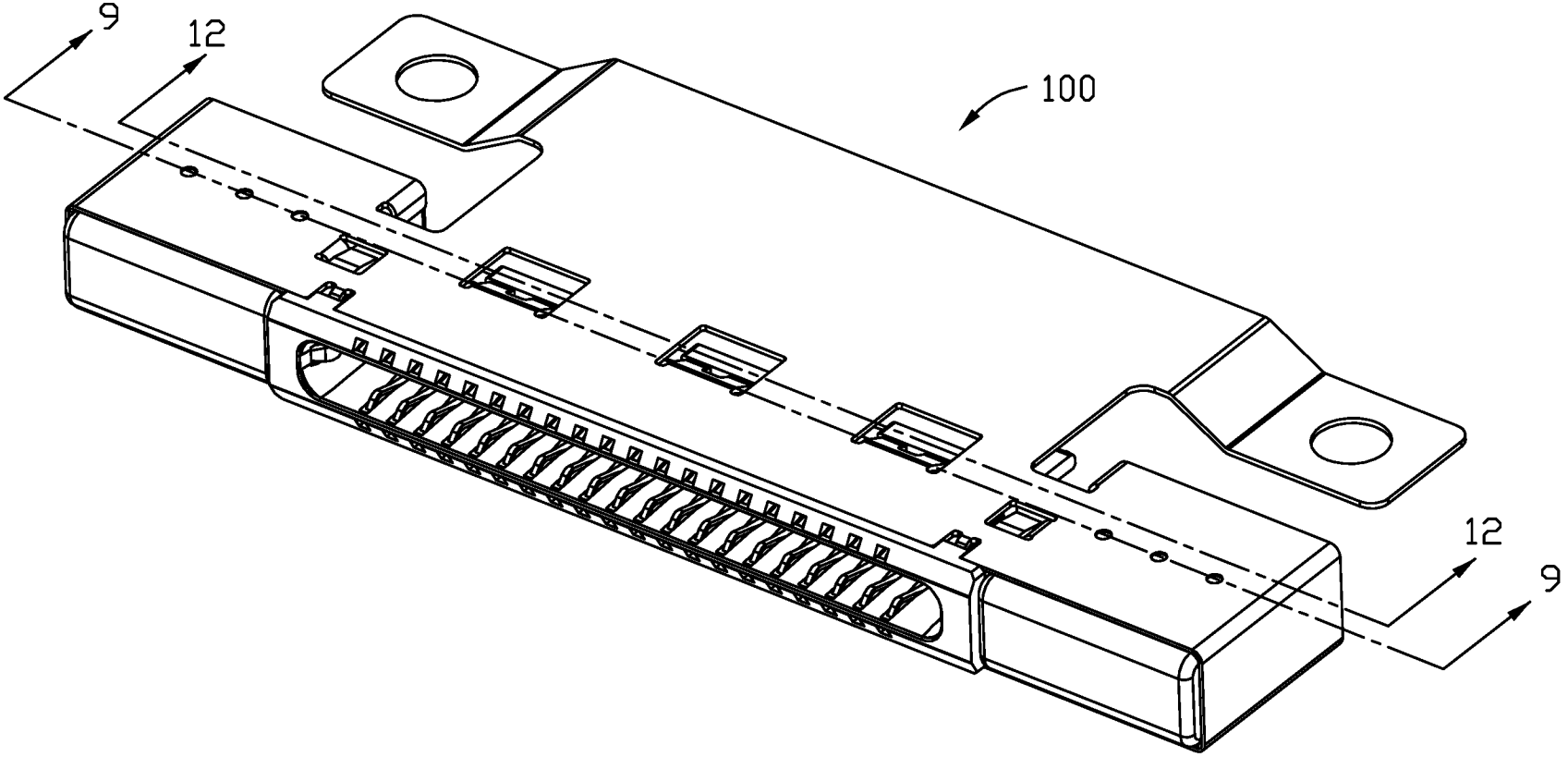
FIG. 1 is a perspective view of an electrical connector in accordance with the present invention.
Figure 2:
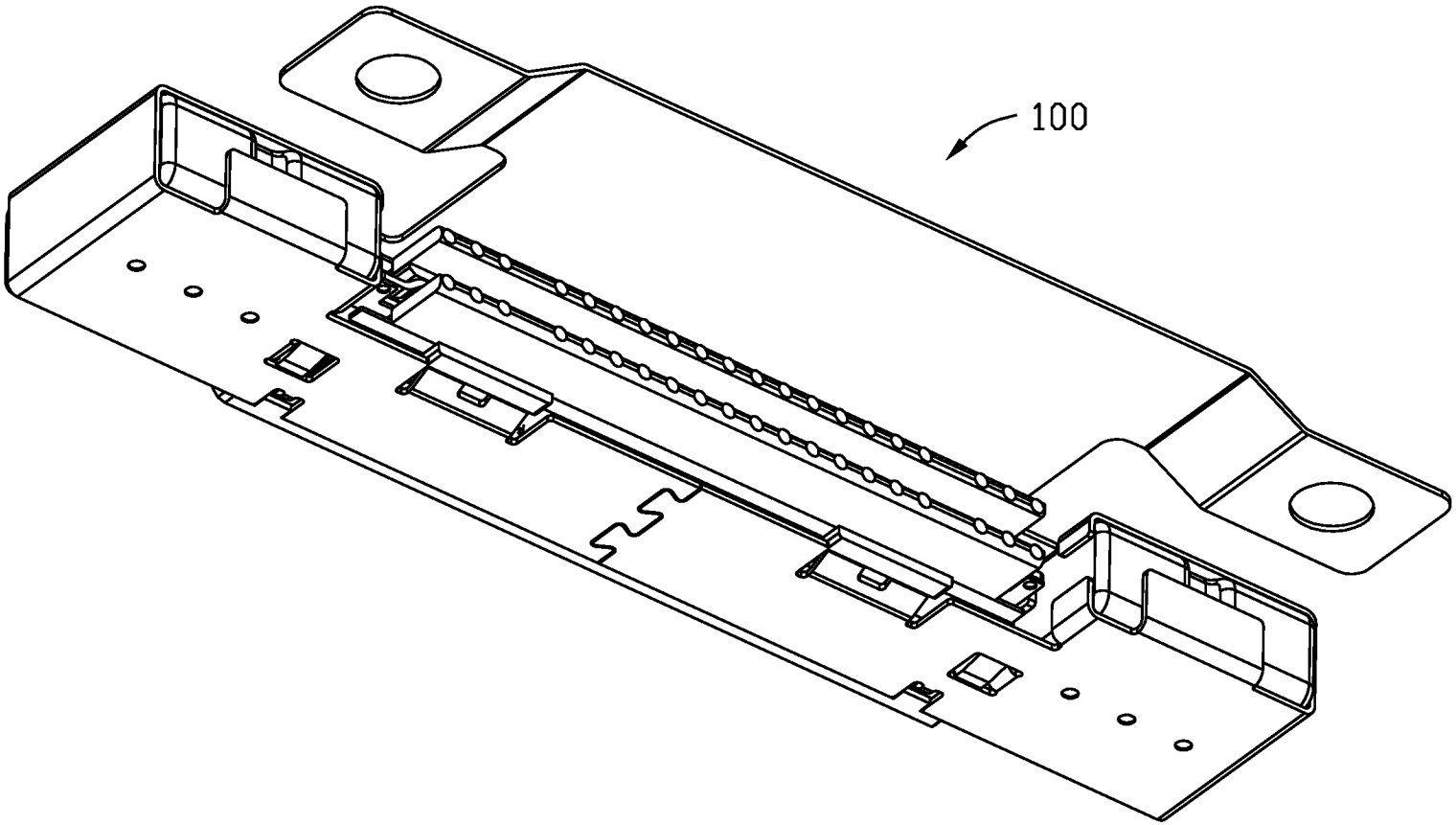
FIG. 2 is another perspective view of the electrical connector of FIG. 1.

Referring to FIGS. 1-9 and 12, an electrical connector 100 includes an insulative housing 1, two rows of contacts 2 retained in the housing 1, a metallic shell 3 enclosing the housing 1, and a pair of magnets 4 retained in the shell 3. The housing 1 includes opposite first longitudinal side wall 11 and second longitudinal side wall 12, and a pair of end walls 13 linked therebetween so as to commonly form a mating cavity 10. The contacts 2 are retained to the first side wall 11 and the second side wall 12, and each contact 2 has a contacting section 21 extending into the mating cavity 10. The shell 3 forms a pair of receiving cavities 31 to receive the corresponding magnets 4 and secure the corresponding magnets 4 via spot-welding with spot S shown on the surface of the shell 3.

Figure 10:
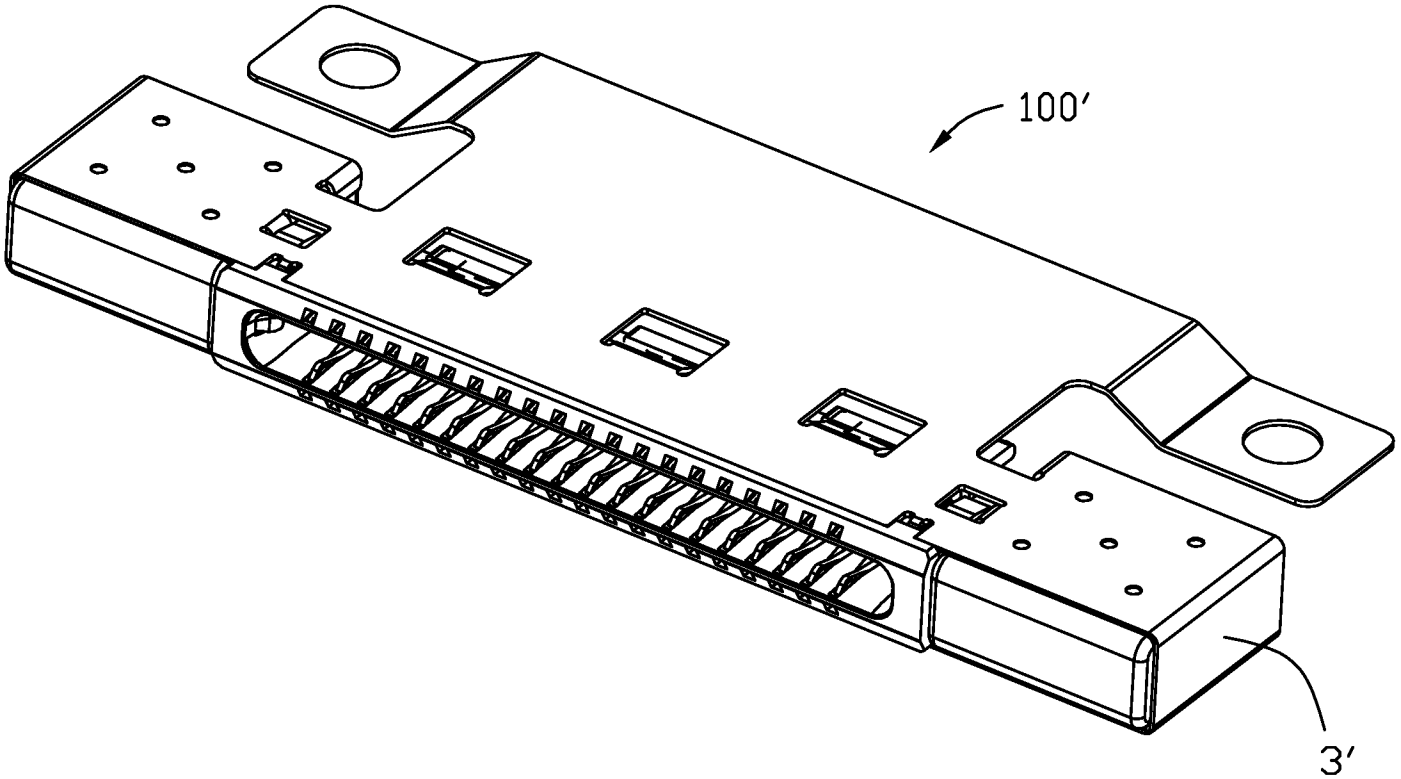
FIG. 10 is a perspective view of the electrical connector according to another embodiment of the invention.
Figure 11:
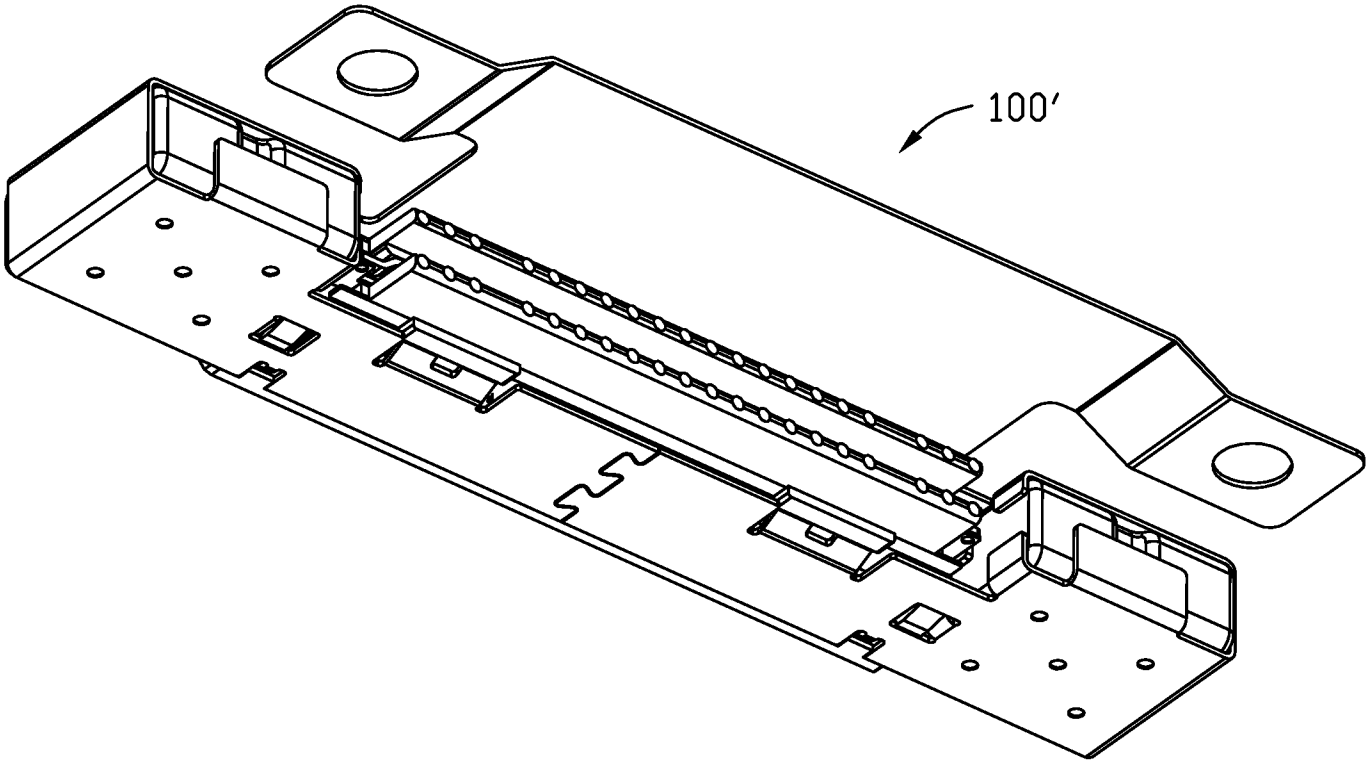
FIG. 11 is another perspective view of the electrical connector of FIG. 10.
Figure 12:
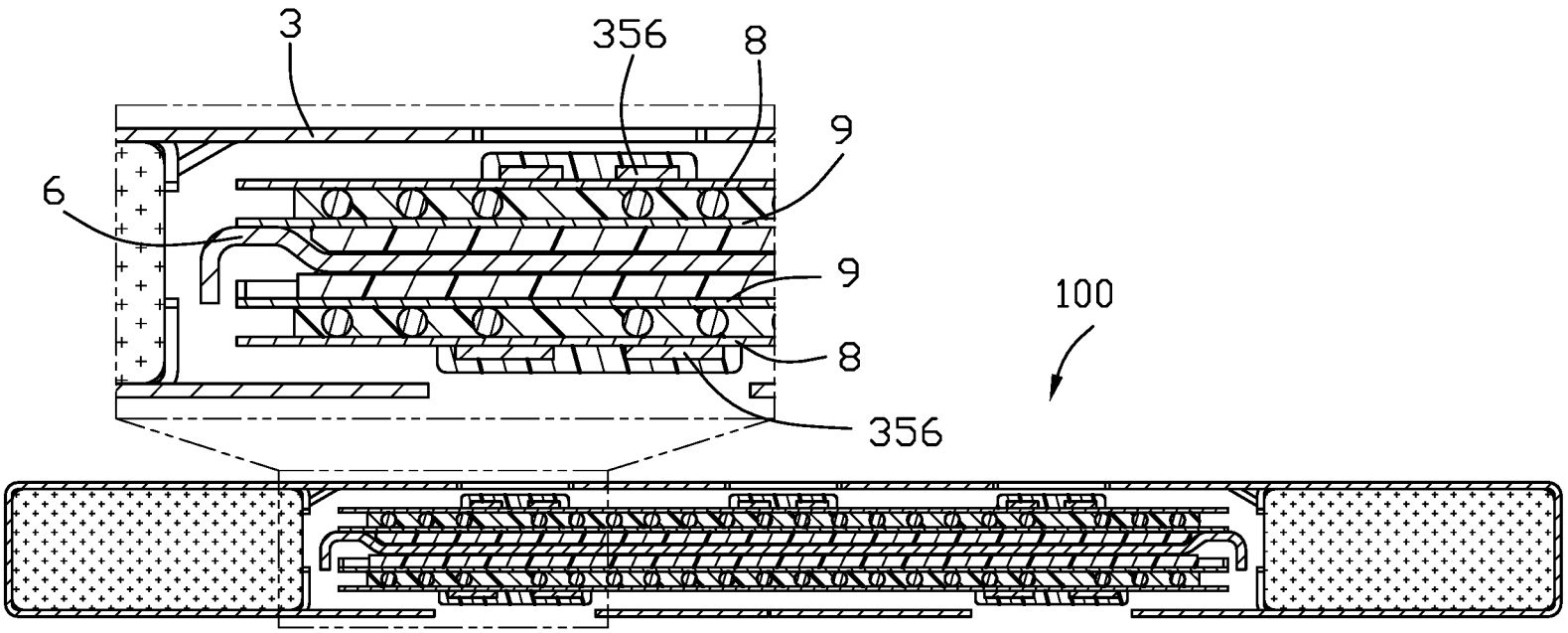
FIG. 12 is another cross-sectional view of the electrical connector of FIG. 1 to show the grounding bars contact the braiding layer of the wires, the shielding plate and the metallic shell.

Notably, in the first embodiment, the spot-welding occurs along a line in the transverse direction while in the second embodiment, the spot-welding occurs evenly on the whole area of the surface, as shown in FIGS. 10-11 wherein the electrical connector 100' has the welding spots in an X-shaped arrangement.

Figure 3:
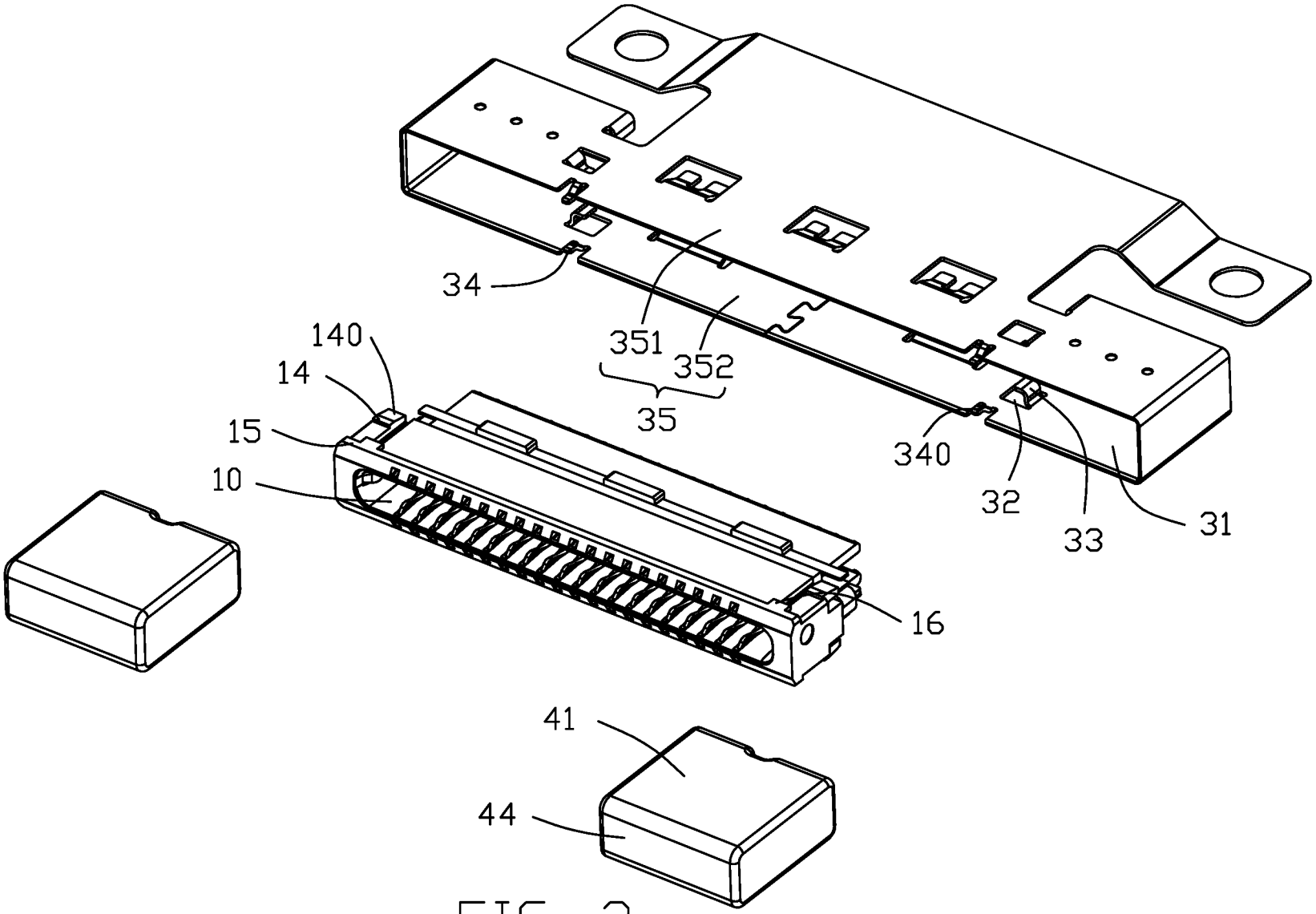
FIG. 3 is an exploded perspective view of the electrical connector of FIG. 1.
Figure 4:
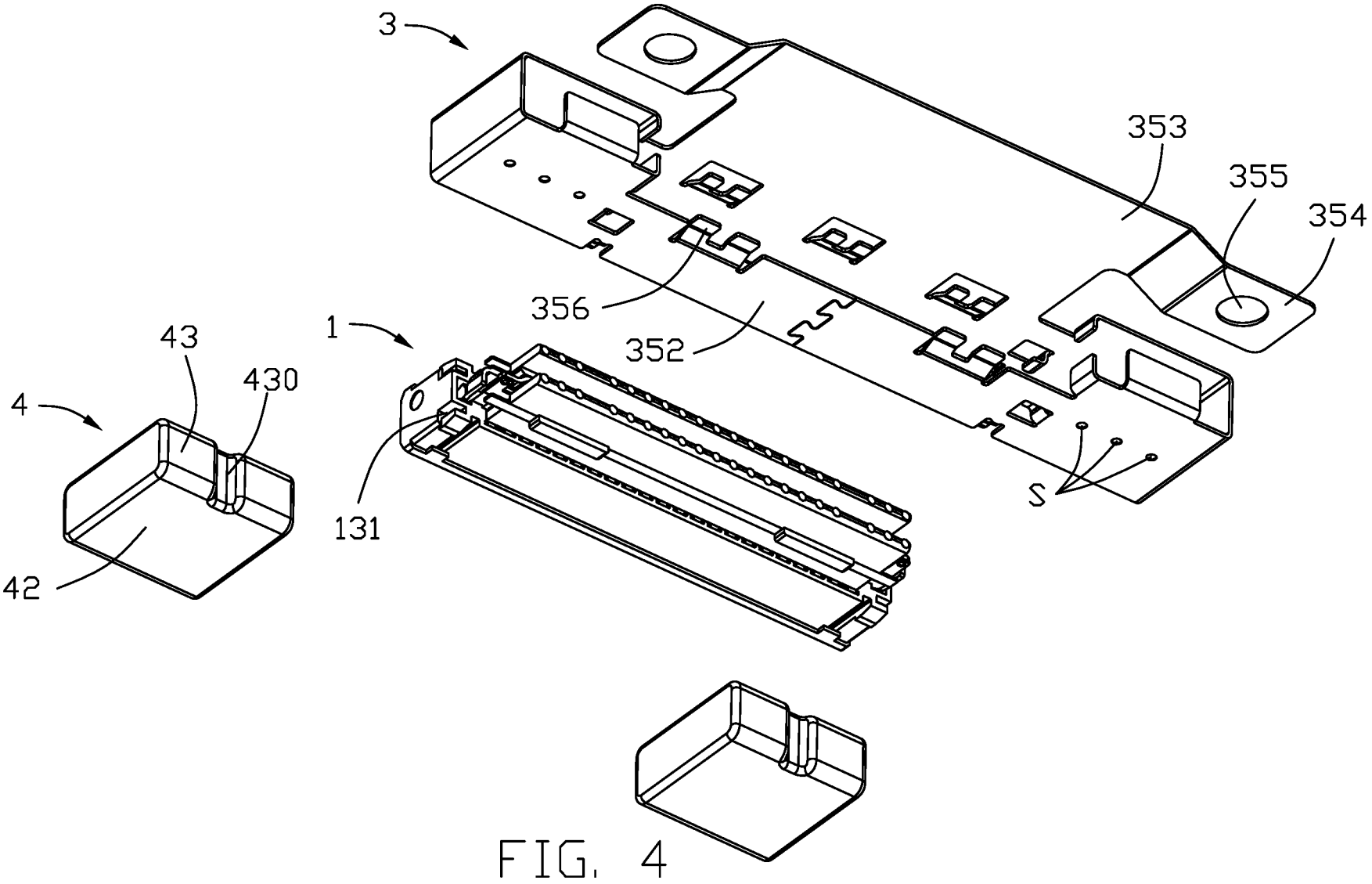
FIG. 4 is another exploded perspective view of the electrical connector of FIG. 3.
Figure 5:
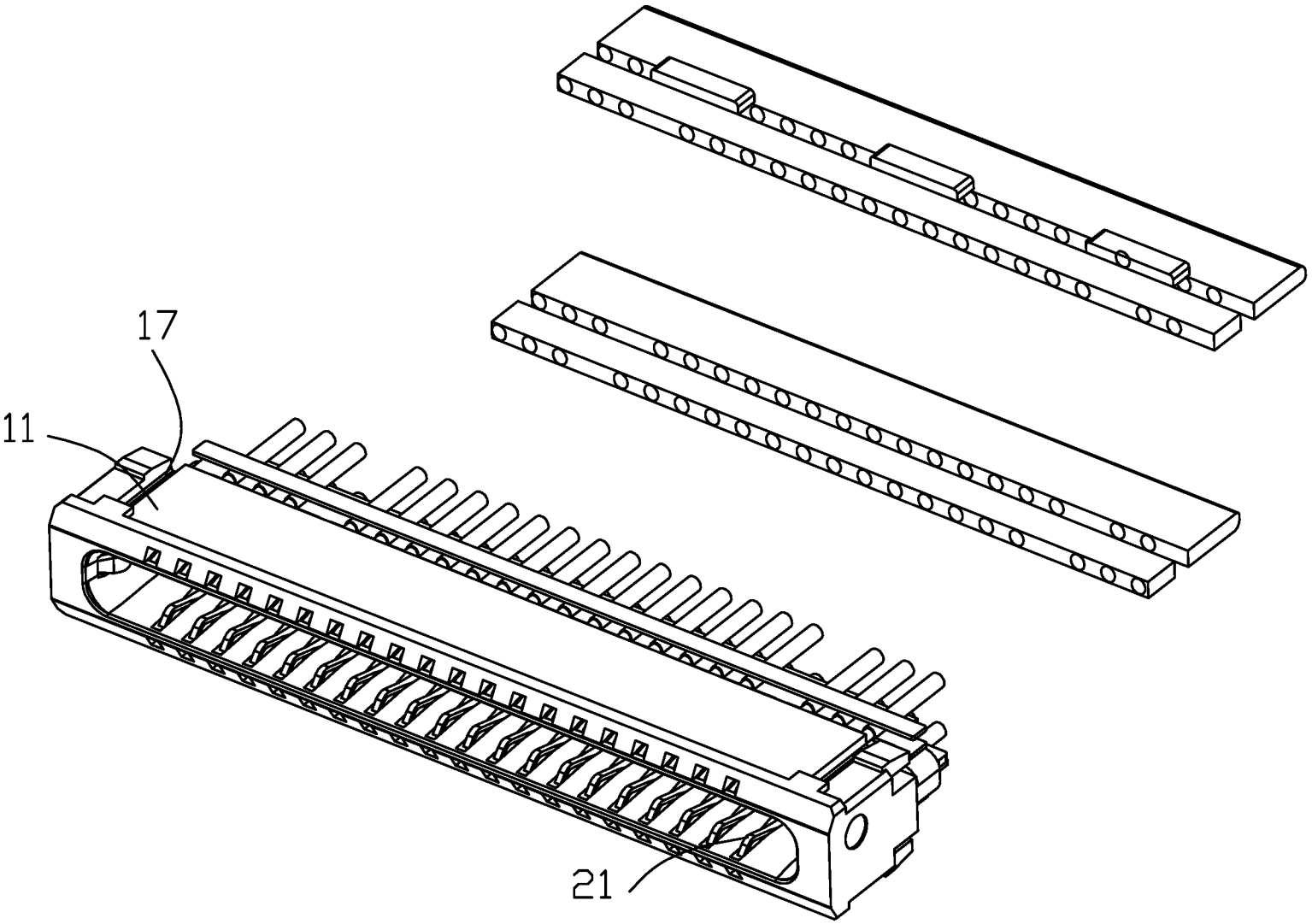
FIG. 5 is a further exploded perspective view of the electrical connector of FIG. 3.
Figure 6:
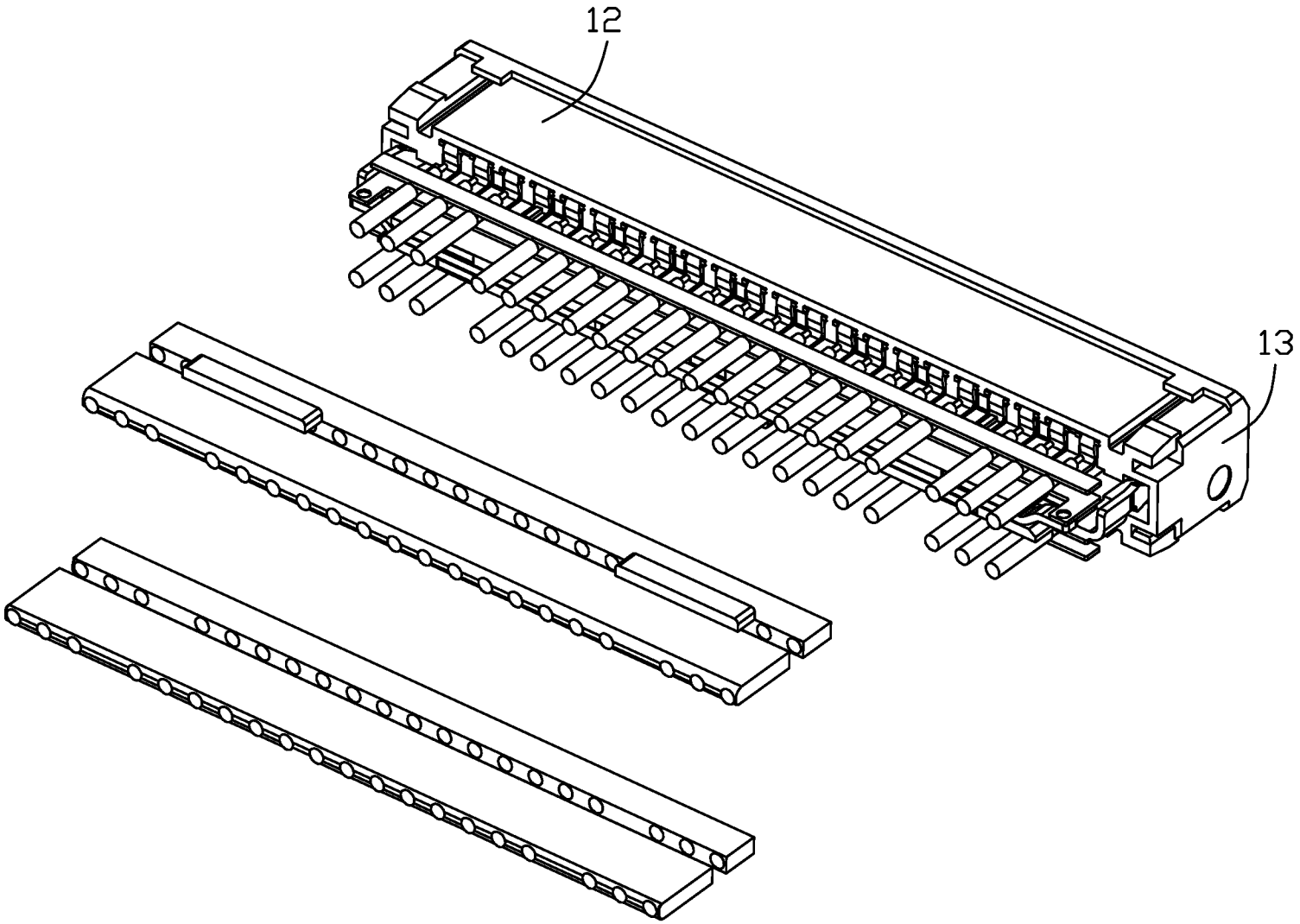
FIG. 6 is another further exploded perspective view of the electrical connector of FIG. 5.
Figure 7:
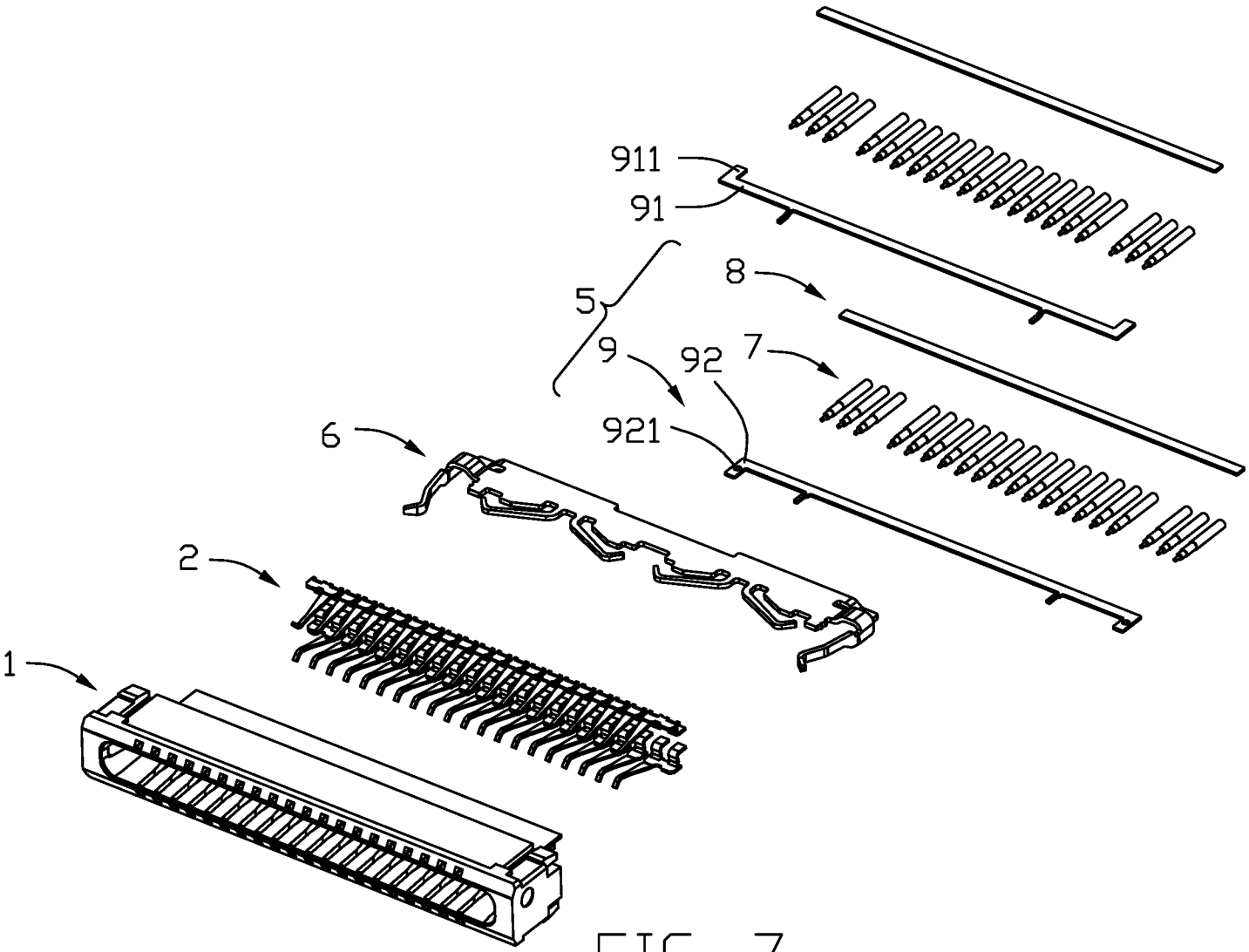
FIG. 7 is a further exploded perspective view of the electrical connector of FIG. 5.
Figure 8:
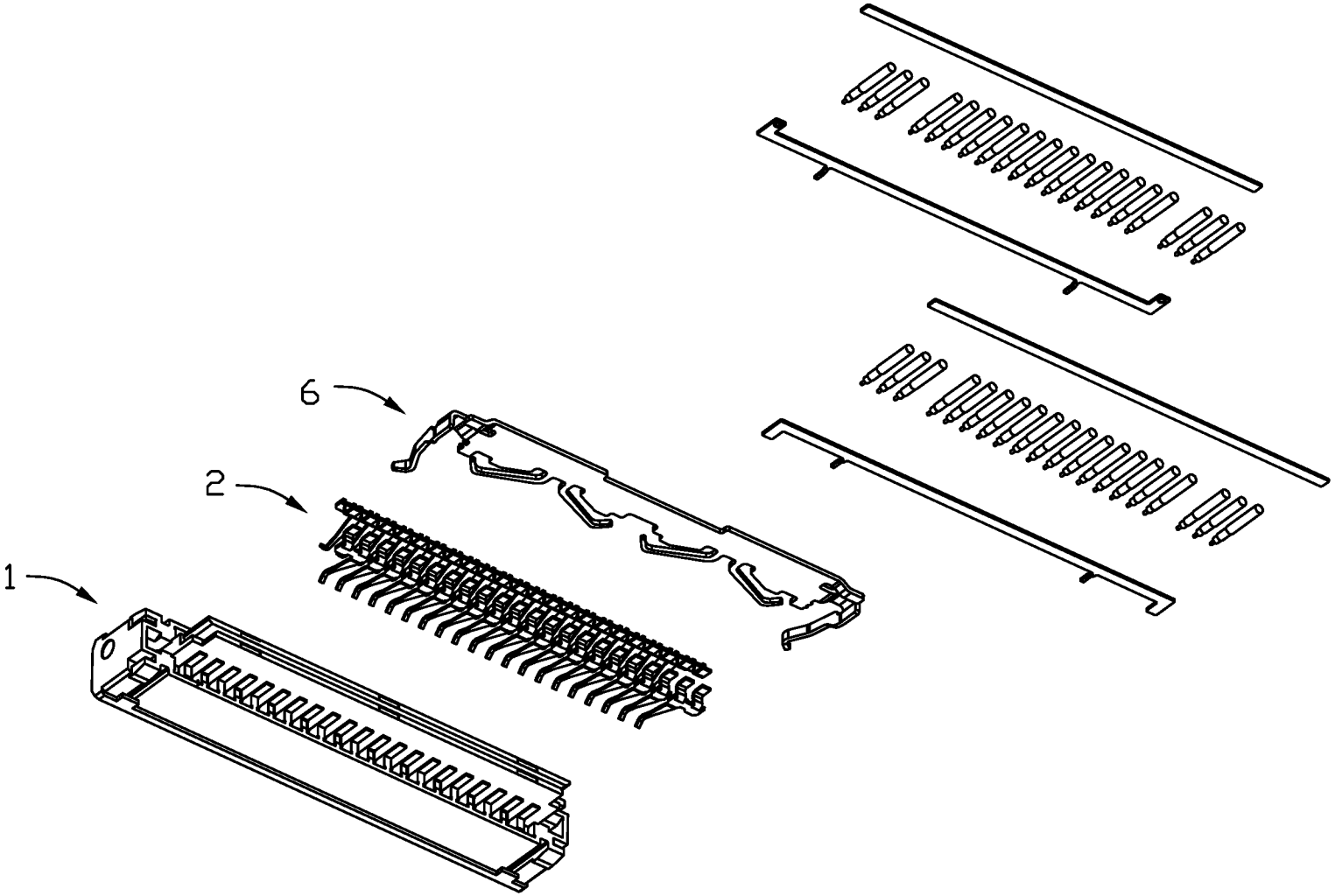
FIG. 8 is another further exploded perspective view of the electrical connector of FIG. 7.
Figure 9:
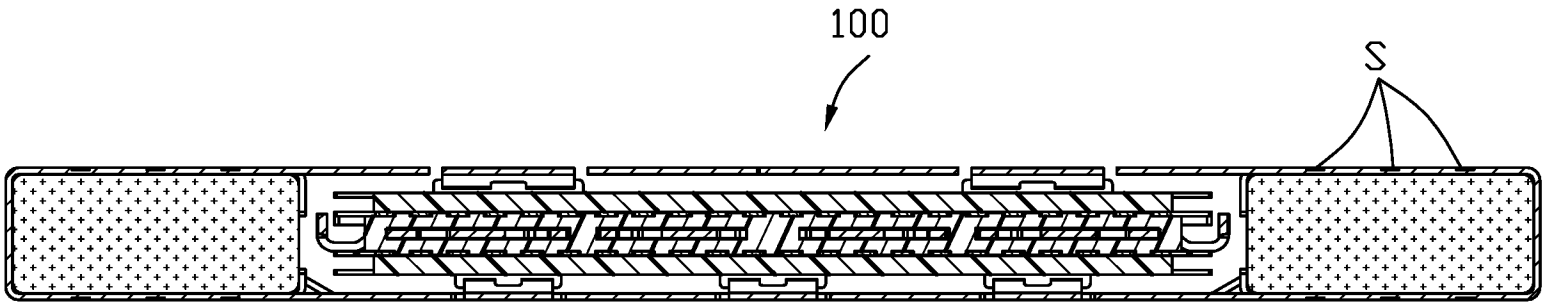
FIG. 9 is a cross-sectional view of the electrical connector of FIG. 1 to show the shell and the magnet intimately contact each other.

As shown in FIGS. 1 and 3, the upper surface 41 and the lower surface 42 of the magnet 4 are both smooth and even. An identification groove 430 is formed in the back side of the magnet 4 for assuring orientation of the magnet 4 during assembling The housing 1 forms, at either end, a groove 131 and an engagement latch 14 with a guiding surface 140. Correspondingly, the shell 3 includes the tab 33 stamped from the hole 32 wherein after assembled, the tab is received within the groove 131, and the engagement latch 14 is received within the hole 32.

The housing 1 further includes an abutment rim 15, and a abutment block 16 rearwardly extending therefrom to be received the corresponding cutout 34 in the front edge of the shell 3. The housing 1 further forms a receiving slot 17 behind the corresponding abutment block 16. The shell 3 includes a cantilevered abutment arm 340 around the corresponding cutout 34 so as to be located under the corresponding abutment block 16 after assembling.

As shown in FIGS. 5-8, the electrical connector 100 further includes two cable units 5 and a metallic shielding plate 6 secured to the housing 1. Each cable unit 5 includes a plurality of wires 7, a first/outer grounding bar 8 and a second/inner grounding bar 9 commonly sandwiching the wires 7 therebetween. Notably, both the first grounding bar 8 and the second grounding bar 9 are mechanically and electrically connected to the braiding layer of each wire 7. The second grounding bar 9 is secured to the shielding plate 6. The wires 7 include upper wires and lower wires. The second grounding bar 9 soldered to the upper wire 7 is the upper grounding bar 91, and that soldered to the lower wires 7 is the lower grounding bar 92. The upper grounding bar 91 includes upper soldering sections 911 soldered to the shielding plate 6, and the lower grounding bar 92 includes lower soldering sections 92 soldered to the shielding plate 6.

In the metallic shell 3, a main part 35 is located between the pair of receiving cavities 31, and includes upper plate 351 and a lower plate 352 respectively located upon the first side wall 11 and the second side wall 12. The main part 35 includes a plate section 353 extending rearwardly from the upper plate 351, and a pair of wings 354 extending outwardly and laterally at two opposite longitudinal ends of the of the plate section 353. Each wing 354 forms a hole 355. The upper plate 351 and the lower plate 352 forms the resilient soldering section/tab 356 to be soldered with the first grounding bar 8.

FIGS. 10-11 show another embodiment wherein the electrical connector 100' uses the two dimensional arrangement of the welding spots instead of the one dimensional arrangement thereof along one line disclosed in the first embodiment.

Compared with the previous design, the welding securement between the metallic shell and the magnet may allow the completeness of both the magnet and the shell, thus enhancing the related effects. In both the embodiments, the magnet 4 is forwardly exposed to an exterior while is rearwardly partially covered by the shell 3 around the corresponding identification groove 430. In another embodiment, the shell may be coated with a soldering layer confronting the magnet in the vertical direction so as to be soldered to the magnet rather than the welding during assembling.

What is claimed is:

1. An electrical connector comprising:

an insulative housing forming a pair of longitudinal side walls and a pair of end walls to commonly form a mating cavity forwardly communicating with an exterior along a front-to-back direction;

two rows of contacts spaced from each other in a vertical direction perpendicular to the front-to-back direction and disposed in the housing with corresponding contacting sections extending into the mating cavity;

two rows of wires mechanically and electrically connected to the corresponding contacts, respectively; and a metallic shell enclosing the housing and forming a pair of receiving cavities at two opposite ends of the housing along a longitudinal direction perpendicular to both the front-to-back direction and the vertical direction to respectively receive a pair of magnets therein; wherein each magnet forms, in the vertical direction, an opposite upper face and bottom face to make intimate contact with a corresponding opposite upper plate and bottom plate of the shell, both the upper face and the lower face are smooth without recesses therein, and both the upper plate and the bottom plate are complete without openings therein; wherein the shell and the magnets are welded or soldered with each other.

2. The electrical connector as claimed in claim 1, wherein a welding or soldering area of said shell and each said magnet is located on at least the upper plate corresponding to the upper face, or the bottom plate corresponding to the bottom face.

3. The electrical connector as claimed in claim 2, wherein the welding or soldering area of said shell and each said magnet is located on both the upper plate corresponding to the upper face, and the bottom plate corresponding to the bottom face.

4. The electrical connector as claimed in claim 1, wherein further including a pair of cable units corresponding to said two rows of contacts and a metallic shielding plate located therebetween in the vertical direction, wherein each cable unit includes one row of wires, an outer grounding bar and an inner grounding bar commonly sandwiching braiding layers of the wires.

5. The electrical connector as claimed in claim 4, wherein the inner grounding bar is mechanically and electrically connected to the shielding plate, and the outer grounding bar is connected to the metallic shell.

6. The electrical connector as claimed in claim 5, wherein the housing forms an engagement latch to be received within a corresponding hole formed in the upper plate of the shell so as to secure the housing to the shell.

7. The electrical connector as claimed in claim 6, wherein the housing further forms a groove to receive a corresponding tab formed on the shell aligned with the hole in the vertical direction.

8. The electrical connector as claimed in claim 5, wherein the shell forms the resilient soldering tab to be soldered to the outer grounding bar, and said resilient grounding bar is exposed to the exterior in the vertical direction.

9. The electrical connector as claimed in claim 1, wherein the magnet is fully forwardly exposed to the exterior in the front-to-back direction.

10. An electrical connector comprising:

an insulative housing forming a pair of longitudinal side walls and a pair of end walls to commonly form a mating cavity forwardly communicating with an exterior along a front-to-back direction;

at least one rows of contacts spaced disposed in the housing with corresponding contacting sections extending into the mating cavity;

two rows of wires mechanically and electrically connected to the corresponding contacts, respectively; and a metallic shell enclosing the housing and forming a pair of receiving cavities at two opposite ends of the housing along a longitudinal direction perpendicular to the front-to-back direction to respectively receive a pair of magnets therein; wherein each magnet forms, in a vertical direction perpendicular to both the front-to-back direction and the longitudinal direction, an opposite upper face and bottom face to make intimate contact with a corresponding opposite upper plate and bottom plate of the shell, both the upper face and the lower face are smooth without recesses therein, and both the upper plate and the bottom plate are complete without openings therein; wherein the shell and the magnets are welded or soldered with each other.

11. The electrical connector as claimed in claim 10, wherein a welding or soldering area of said shell and each said magnet is located on at least the upper plate corresponding to the upper face, or the bottom plate corresponding to the bottom face.

12. The electrical connector as claimed in claim 11, wherein the welding or soldering area of said shell and each said magnet is located on both the upper plate corresponding to the upper face, and the bottom plate corresponding to the bottom face.

13. The electrical connector as claimed in claim 10, wherein further including a cable unit corresponding to said at least one row of contacts and a metallic shielding plate located therebetween in the vertical direction, wherein each cable unit includes one row of wires, an outer grounding bar and an inner grounding bar commonly sandwiching braiding layers of the wires.

14. The electrical connector as claimed in claim 13, wherein the inner grounding bar is mechanically and electrically connected to the shielding plate, and the outer grounding bar is connected to the metallic shell.

15. The electrical connector as claimed in claim 14, wherein the housing forms an engagement latch to be received within a corresponding hole formed in the upper plate of the shell so as to secure the housing to the shell.

16. The electrical connector as claimed in claim 15, wherein the housing further forms a groove to receive a corresponding tab formed on the shell aligned with the hole in the vertical direction.

17. The electrical connector as claimed in claim 14, wherein the shell forms the resilient soldering tab to be soldered to the outer grounding bar, and said resilient grounding bar is exposed to the exterior in the vertical direction.

18. The electrical connector as claimed in claim 10, wherein the magnet is fully forwardly exposed to the exterior in the front-to-back direction.

19. An electrical connector comprising:

an insulative housing forming a pair of longitudinal side walls and a pair of end walls to commonly form a mating cavity forwardly communicating with an exterior along a front-to-back direction;

at least one rows of contacts spaced disposed in the housing with corresponding contacting sections extending into the mating cavity;

two rows of wires mechanically and electrically connected to the corresponding contacts, respectively; and a metallic shell enclosing the housing and forming at least one receiving cavities beside the housing along a longitudinal direction perpendicular to the front-to-back direction to respectively receive a magnet therein; wherein each said magnet forms, in a vertical direction perpendicular to both the front-to-back direction and the longitudinal direction, an opposite upper face and bottom face to make intimate contact with a corresponding opposite upper plate and bottom plate of the shell, both the upper face and the lower face are smooth without recesses therein, and both the upper plate and the bottom plate are complete without openings therein; wherein the shell and the magnet are welded or soldered with each other.

20. The electrical connector as claimed in claim 19, wherein a welding or soldering area of said shell and each said magnet is located on at least the upper plate corresponding to the upper face, or the bottom plate corresponding to the bottom face.

* * * * *